US005251834A

United States Patent [19]

Ikegami et al.

[11] Patent Number: 5,251,834

[45] Date of Patent: Oct. 12, 1993

[54] TRAVELING WIRE TAKE-UP METHOD AND ITS APPARATUS

[75] Inventors: Yoshio Ikegami; Tadashi Kouge; Hiroaki Aoyanagi; Kaoru Morinaga, all of Kobe, Japan

[73] Assignee: Kabushiki Kaisha Kobe Seiko Sho, Kobe, Japan

[21] Appl. No.: 886,847

[22] Filed: May 22, 1992

[30] Foreign Application Priority Data

May 23, 1991 [JP] Japan ..... 3-149602

[51] Int. Cl.[5] ..... B65H 67/052

[52] U.S. Cl. ..... 242/25 A

[58] Field of Search ..... 242/25 A, 25 R, 18 A

[56] References Cited

U.S. PATENT DOCUMENTS 2,929,569 3/1960 Detrick et al. ..... 242/25 A
2,932,462 4/1960 Nelson ..... 242/25 A
3,064,912 11/1962 Bittman ..... 242/25 A
3,169,715 2/1965 Ludwig ..... 242/25 A
3,408,013 10/1968 Hauck et al. ..... 242/25 A
3,877,653 4/1975 Foltyn et al. ..... 242/25 A

*Primary Examiner*—Stanley N. Gilreath
*Attorney, Agent, or Firm*—Oblon, Spivak, McClelland, Maier & Neustadt

[57] ABSTRACT

In a traveling wire take-up method and machine of a wire coating line, a wire shifting guide lever of a take-up machine shifts a traveling wire toward a snagger of a bobbin holder to change over from a presently take-up bobbin to an empty bobbin. A take-up tension of the traveling wire is increased before the changeover operation, and the take-up tension of the traveling wire is reduced to a predetermined take-up tension after the changeover operation has been finished. Furthermore, increase and decrease of the take-up tension is preferably controlled by adjusting an output of a sheave motor in a dancer roller disposed in front of the take-up machine.

11 Claims, 5 Drawing Sheets

FIG. 4A
PRIOR ART
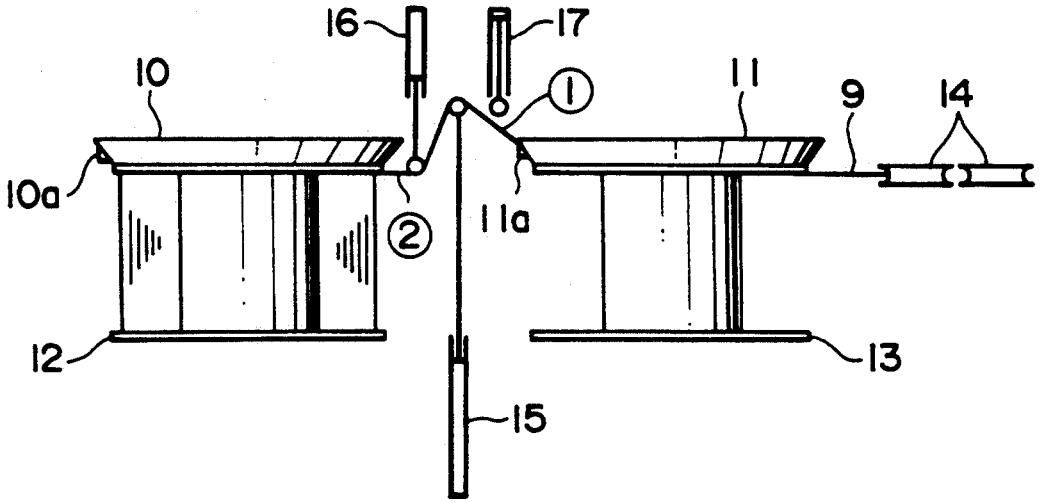
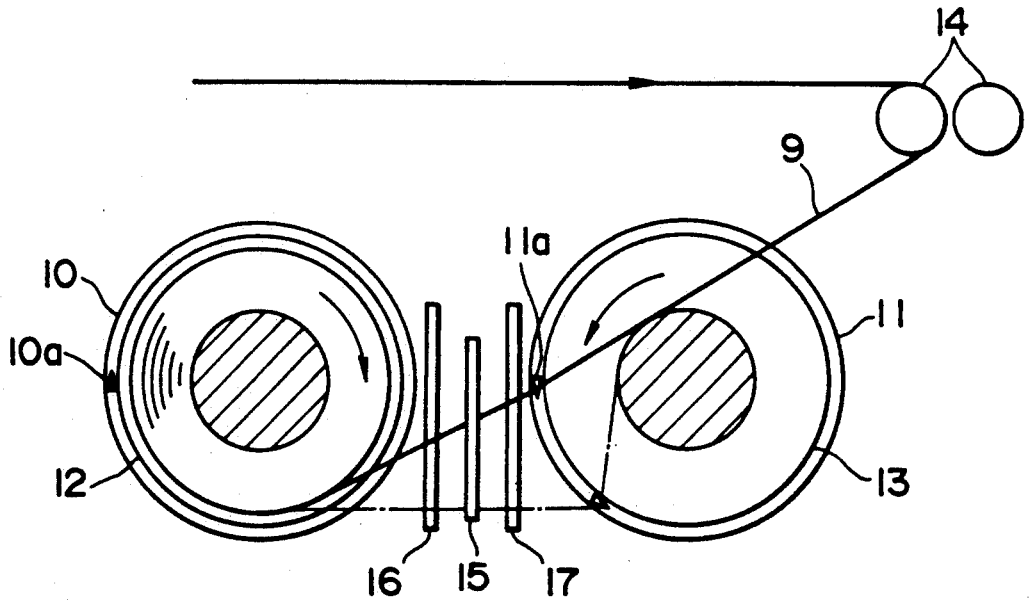
FIG. 4B
PRIOR ART

TRAVELING WIRE TAKE-UP METHOD AND ITS APPARATUS

BACKGROUND OF THE INVENTION

1. Field of the Invention

The present invention relates to a take-up machine of a wire coating line, particularly to a traveling wire take-up method and its method capable of reducing failures of changeover from a bobbin presently (currently) taking up a traveling wire to an empty bobbin.

2. Description of Related Art

First of all, a generic construction of a wire coating line is explained by taking an example of a tandem insulating coating line of FIG. 5. The wire coating line includes a wire drawing machine 1, an annealing machine 2, an extruding machine 3, a cooling trough 4, a capstan 5, a dancer roller 6, and a take-up machine 7 being disposed in this order. In the drawing, a reference numeral 8 denotes a control board.

A copper wire drawn to be a predetermined radius in the drawing machine 1 is heated in the annealing machine 2 so as to remove work hardening and, in turn, is preliminary heated at a predetermined temperature. Then, in the extruding machine 3, an insulating coating such as a solid polyethylene is applied on the preheated copper wire. And, this coating layer is cooled down by cooling water in the cooling trough 4 and, subsequently, driven by the capstan 5 at a predetermined speed. This capstan 5 determines a traveling speed of the traveling wire 9. The traveling speed can be increased up to 2000–2500 m/min. Further, this traveling wire 9 is taken up by the take-up machine 7 via the dancer roller 6. This dancer roller 6 comprises a fixed sheave and a movable sheave. By detecting a position of the movable sheave, a rotational speed of the bobbin is controlled to be reduced in accordance with a winding thichness of the presently taking up bobbin in the take-up machine 7.

Moreover, the movable sheave is driven by a torque motor so as to provide the traveling wire 9 reaching the take-up machine 7 with a predetermined tension. The take-up machine 7 comprises a presently take-up bobbin and an empty bobbin, so that the bobbin presently taking up the traveling wire is automatically changed over to the empty bobbin.

Next, referring to FIGS. 3 and 4, an automatic changeover operation is explained. FIG. 3 shows a condition before the changeover operation is carried out. FIG. 4 shows a condition while the changeover operation is progressing. In FIG. 3, reference numerals 10, 11 denote bobbin holders having snaggers 10*a*, 11*a*. A reference numeral 12 denotes a presently take-up bobbin installed on the bobbin holder 10. A reference numeral 13 denotes an empty bobbin installed on the bobbin holder 11. A reference numeral 14 denotes a traverser, and a reference numeral 15 denotes a main wire shifting guide 15. Reference numerals 16, 17 denote sub wire shifting guides. Shortly before a take-up length of the presently take-up bobbin 12 reaches a predetermined value, the empty bobbin 13 is caused to rotate at a speed synchronous with the take-up speed of the presently take-up bobbin 12.

And further, in the before-changeover condition of FIG. 3, the traverser 14 shifts in a traverse direction toward a position indicated in the drawing and stops at an end in a widthwise direction. Then, the traveling wire 9 is continuously taken up in the presently take-up bobbin 12 in the condition where the traveling wire 9 contacts with the empty bobbin 13.

And, in the changeover condition of FIG. 4 wherein the winding thickness in the bobbin 12 has reached a predetermined value, the main wire shifting guide 15 and the sub wire shifting guide 16 advance to the positions shown in the drawing. The traveling wire 9 is hooked by the snagger 11*a* at the portion indicated by the number (1) so that an automatic changeover to the empty bobbin 13 can be accomplished. To the contrary, the traveling wire 9 is spaced far from the snagger 10*a* at the portion indicated by the number (2).

However, in above traveling wire take-up method explained with reference to FIG. 4 in which the wire shifting levers 15, 16, and 17 are used, a tension of the traveling wire varies due to friction. For example, in the case where the apparatus is driven with a take-up tension of 1 Kg in the before-changeover condition of FIG. 4, the take-up tension of the traveling wire 9 increases, for example, 1.3 Kg at the position (2). To the contrary, the take-up tension of the traveling wire 9 decreases, for example, 0.7 Kg at the position (1).

Therefore, a force for tearing off the traveling wire by the snagger 11*a* becomes weak, thereby increasing probability of changeover failure. Namely, this phenomenon is the same as the case that the wire is cut by scissors, wherein cutting operation becomes harder as tension force becomes smaller. If changeover failure occurs, not only a large amount of inferior wires are generated but approximately one hour is required to resume the normal condition. As a result, the working rate of the wire coating line is greatly reduced.

SUMMARY OF THE INVENTION

Accordingly, the present invention has a purpose, in view of above-described problems and disadvantages encountered in the above related art technologies and needs, to provide a traveling wire take-up method and its apparatus capable of reducing changeover failures as much as possible.

To accomplish this end, according to the present invention, there is provided a traveling wire take-up method wherein a wire shifting guide lever of a take-up machine shifts a traveling wire toward a snagger of a bobbin holder to change over from a presently take-up bobbin to an empty bobbin, and said method comprising steps of increasing a take-up tension of the traveling wire before the changeover operation, and reducing the take-up tension of the traveling wire to a predetermined take-up tension after the changeover operation has been finished. Furthermore, it is preferable that such increase and decrease of the take-up tension is controlled by adjusting an output of a sheave motor in a dancer roller disposed in front of the take-up machine.

With such an arrangement, if the take-up tension of the traveling wire is increased as a whole, it becomes possible to compensate tension reduction phenomenon of the traveling wire due to friction force of the wire shifting lever at the certain portion of the traveling wire to be torn off by the snagger. Furthermore, since the driving motor of the sheave in the dancer roller can adjust the take-up tension, an output of this motor can be controlled to increase or decrease the take-up tension.

The above and other objects, features and advantages of the present invention will become more apparent from the following detailed description and the appended claims which are to be read in conjunction with the accompanying drawings. However, the drawings are merely illustrative and not restrictive to limit the scope of the invention.

BRIEF DESCRIPTION OF THE DRAWINGS

FIGS. 4A and 4B are plan and elevational views, respectively, showing a conventional condition where the take-up machines are just changed over.

DETAIL DESCRIPTION OF THE PREFERRED EMBODIMENT

Hereinafter, referring now to the accompanying drawings, a preferred embodiment of the present invention is explained in detail.

Figure 1:
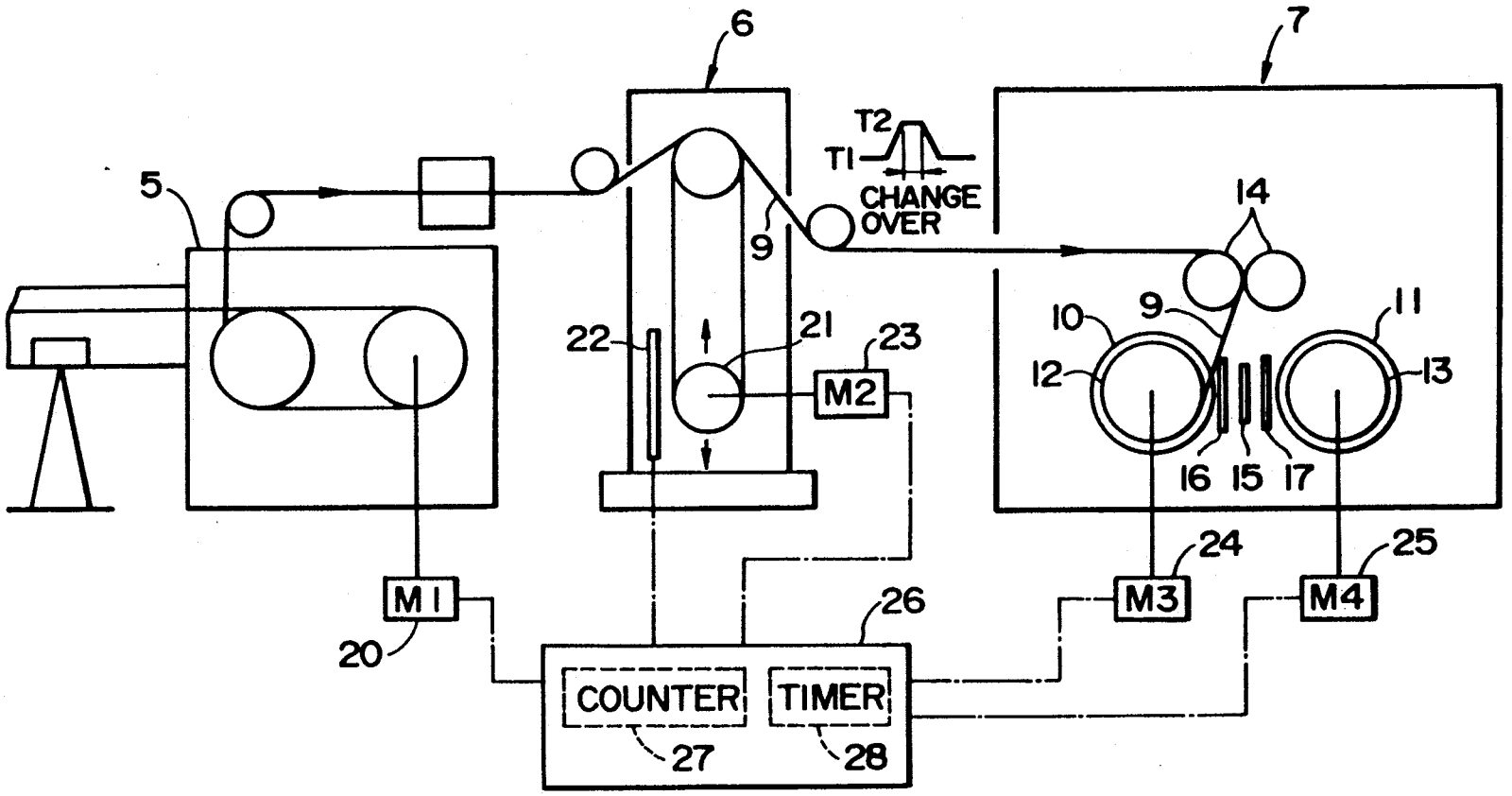
FIG. 1 is a schematic view showing a construction of an apparatus for practicing a take-up method in accordance of the present invention.

FIG. 1 is a schematic view showing a construction of an apparatus for practicing a take-up method in accordance of the present invention. In FIG. 1, a reference numeral 20 denotes a motor of the capstan 5, and a reference numeral 21 denotes a movable sheave of the dancer roller 6. A reference numeral 22 denotes a position detector of the movable sheave 21, and a reference numeral 23 denotes a torque motor assembled in the movable sheave 21. A reference numeral 24 denotes a motor of the bobbin holder 10, and a reference numeral 25 denotes a motor of the empty bobbin holder 11. A reference numeral 26 denotes a control unit, and a reference numeral 27 denotes a counter installed in the control unit 26. And, a reference numeral 28 denotes a timer installed in the control unit 26.

During a normal take-up operation, a rotational speed of the motor 24 of the presently take-up bobbin holder 10 is reduced in response to an output of the position detector 22 which detects an up and a down movement of the movable sheave 21, so that the rotational speed of the bobbin can be varied in accordance with winding thickness of the traveling wire.

Figure 3A:
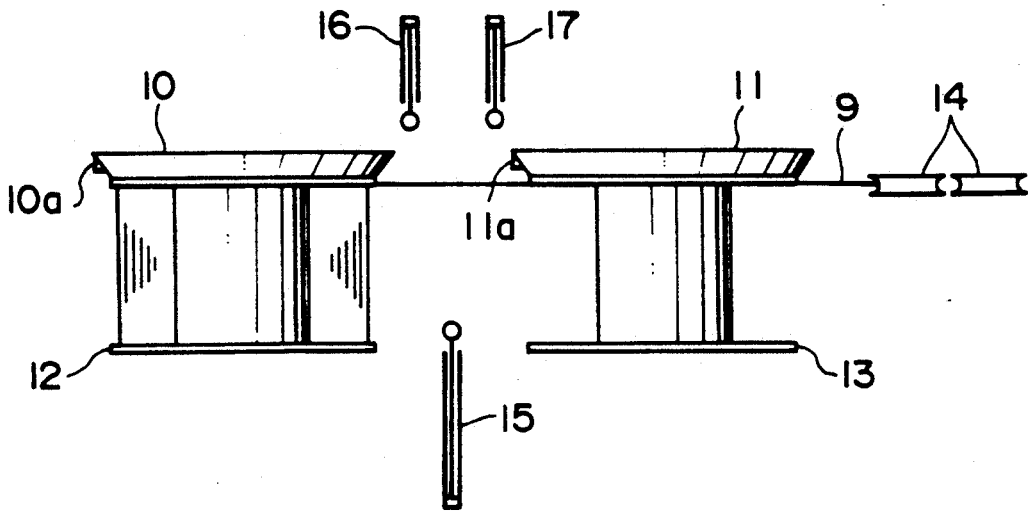
FIG. 3A PRIOR ART
FIGS. 3A and 3B are plan and elevation views, respectively, showing a conventional condition where the take-up machines are not changed over.
Figure 3B:
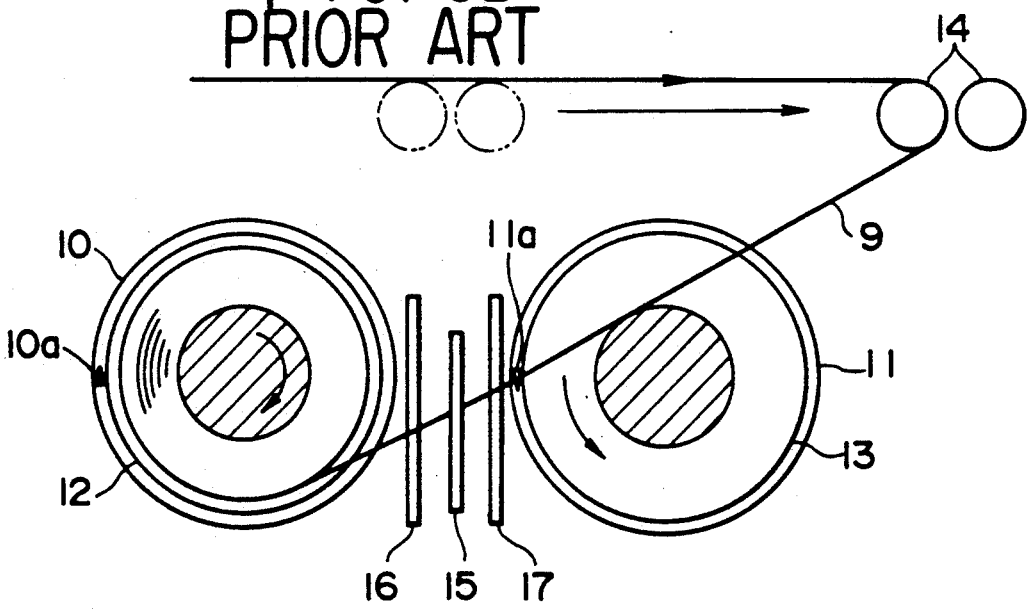
FIG. 3B PRIOR ART
Figure 5:
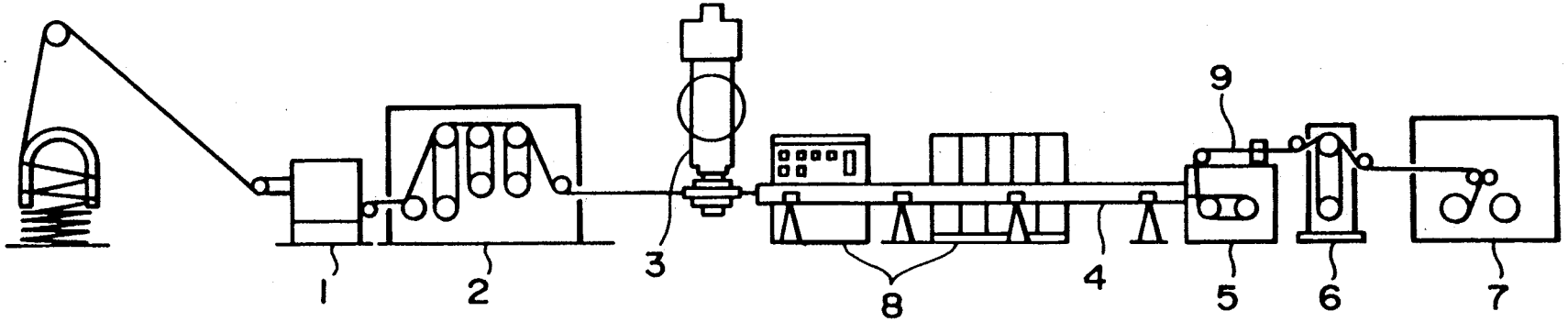
FIG. 5 PRIOR ART
FIG. 5 is a schematic view showing a layout of a wire coating line.

And further, the torque motor 23 gives a take-up tension (T1) to the traveling wire 9 in accordance with its output, i.e., it rotates the sheave 21 in a direction opposite the movement of the wire. The counter 27 generates a signal before the take-up length reaches a predetermined value so as to initiate to drive the motor 25 of the empty bobbin holder 11. At the same time, an output of the torque motor 23 is increased, the take-up tension T1 is increased so as to reach to T2. And then, in a condition where the take-up tension is T2, the automatic changeover operation is carried out as shown in FIGS. 3 and 4. Furthermore, when the timer 28 detects the timing of finishing this automatic changeover operation, an output of the torque motor 23 is reduced so that the take-up tension is gradually reduced from T2 to T1, thereby resuming normal take-up operation.

Figure 2:
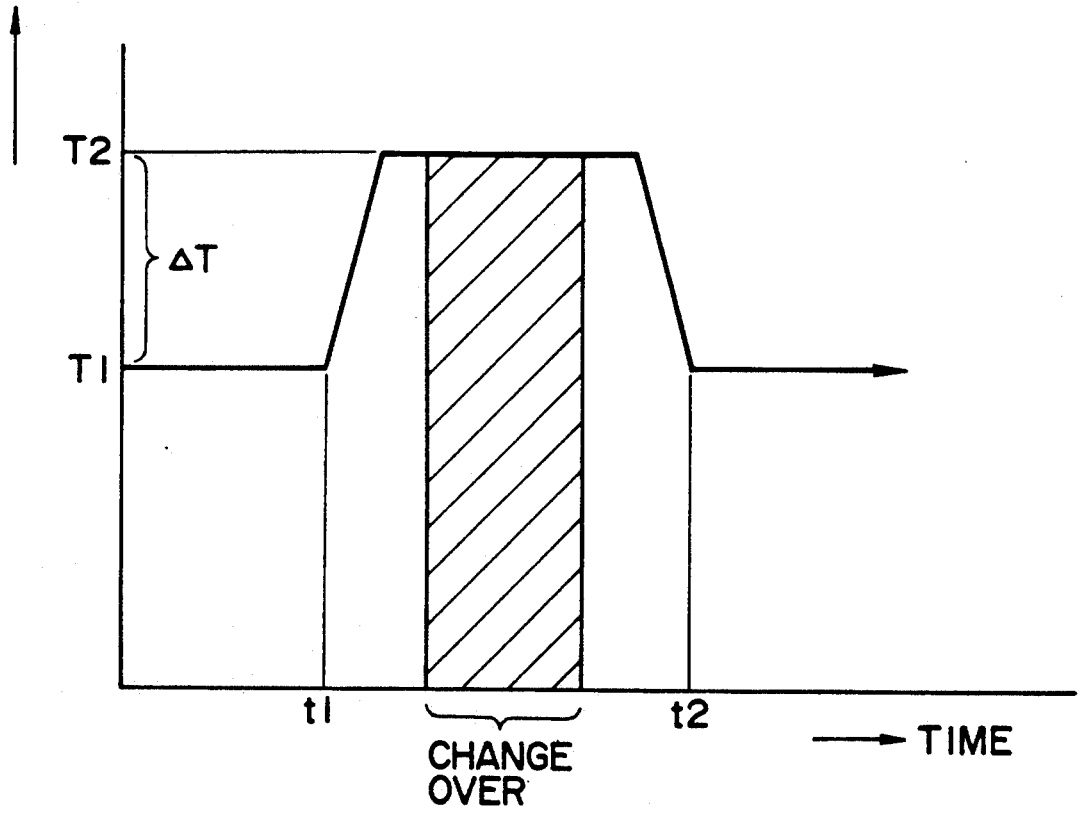
FIG. 2 is a graph showing change of take-up tension.

FIG. 2 is a graph showing one example of change of take-up tension. The take-up tension is increased from T1 to T2 at a timing t1 shortly before the changeover operation so as to increase the take-up tension by an amount $\Delta T$. If this increased amount $\Delta T$ is determined to be equal to a tension reduction amount occurring at a portion (1) of the traveling wire 9 shown in FIG. 4, an apparent tension reduction of the traveling wire 9 does not occur at the portion (1). Then, when the changeover has been finished, the take-up tension is reduced promptly to the normal tension T1 at the timing t2. By virtue of this operation, changeover failure which is derived from reduction of traveling wire tension occurring when torn off by the snagger 11*a* of FIG. 4 is completely prevented from occurring.

Though the increase or decrease of take-up tension is controlled by the torque motor 23 of the dancer roller 6 in this embodiment, it is also possible to provide an additional tension helper between the dancer roller 6 and the take-up machine 7 to increase or decrease the take-up tension.

Furthermore, though the timing of increase or decrease of the take-up tension is controlled by use of the counter 27 and the timer 28, it is also possible to increase or decrease the take-up tension in connection with the wire shifting levers 15, 16, and 17.

In accordance with the traveling wire take-up method of the present invention, a wire shifting guide lever of a take-up machine shifts a traveling wire toward a snagger of a bobbin holder to change over from a presently take-up bobbin to an empty bobbin. The method further increases a take-up tension of the traveling wire before the changeover operation, and reduces the take-up tension of the traveling wire to a predetermined take-up tension after the changeover operation has been finished.

Therefore, by increasing the take-up tension of the traveling wire as a whole, it becomes possible to compensate for the tension reduction phenomenon of the traveling wire due to friction force of the wire shifting lever at the certain portion of the traveling wire to be torn off by the snagger. Therefore, changeover failures due to reduction of tension can be reduced.

Furthermore, the increase and decrease of the take-up tension can be controlled by adjusting an output of the sheave motor in the dancer roller disposed in front of the take-up machine. Since the sheave motor inherently adjusts the take-up tension, the control of increase and decrease of the take-up tension can be easily carried out.

Having now fully described the present invention, it will be apparent to one of ordinary skill in the art that many changes and modifications can be made thereto without departing from the spirit and scope of the present invention as set forth herein.

What is claimed is:

1. A traveling wire take-up method comprising the steps of:

winding a wire on a current take-up bobbin;

shifting the traveling wire toward a snagger of a bobbin holder having an empty bobbin by engaging the wire with a shifting guide lever of a take-up machine in order to change over the wire from the current take-up bobbin to the empty bobbin;

increasing a take-up tension of the wire before the shifting step; and reducing the take-up tension of the wire after the completion of the shifting step.

2. A traveling wire take-up method in accordance with claim 1, wherein said increasing and reducing steps are controlled by adjusting an output of a sheave motor in a sheave of a dancer roller disposed in front of the take-up machine, the wire being wound on the sheave.

3. A traveling wire take-up method in accordance with claim 2 in which the empty bobbin holder has a motor, wherein said shifting step comprises driving the motor of the empty bobbin holder before a wire on the current take-up bobbin reaches a predetermined length, and increasing an output of a motor provided for driving said sheave.

4. A traveling wire take-up method in accordance with claim 3 including, in said shifting step, using a timer to reduce an output of a motor for driving said sheave and so to reduce the take-up tension of the traveling wire to a predetermined value when a predetermined time has elapsed after finishing changeover of the bobbins.

5. A traveling wire take-up apparatus comprising:

a bobbin holder for holding a current take-up bobbin;

a bobbin holder, having a snagger, for holding an empty bobbin;

a take-up machine having a wire shifting guide lever comprising means for shifting a traveling wire toward the snagger in order to change over the wire from the current take-up bobbin to the empty bobbin; and means positioned upstream of the bobbin holders in a moving direction of the traveling wire for increasing the take-up tension of the traveling wire before changing over the wire from the current take-up bobbin to the empty bobbin and for decreasing the take-up tension of the travelling wire after so changing over the wire.

6. A traveling wire take-up apparatus according to claim 5, wherein said means for increasing or decreasing tension comprises a movable sheave and a torque motor driving said movable sheave.

7. A traveling wire take-up apparatus in accordance with claim 6, wherein said sheave includes means for increasing the tension of the traveling wire.

8. A traveling wire take-up apparatus in accordance with claim 7 wherein said sheave includes means for decreasing the tension of the traveling wire to a predetermined value after having finished the changeover of the bobbins.

9. A traveling wire take-up apparatus in accordance with claim 8 in which said dancing roller further comprises a fixed sheave.

10. A traveling wire take-up apparatus in accordance with claim 8 including a timer and a counter which controls timing of increasing or decreasing the take-up tension of the traveling wire, wherein the counter counts a length having been taken up and the timer detects a pre-set time.

11. A traveling wire take-up apparatus in accordance with claim 10 in which said counter is connected to a motor of a capstan, wherein the capstan drives the traveling wire at a predetermined speed.

* * * * *